United States Patent [19]

Iwano et al.

[11] Patent Number: 5,044,140

[45] Date of Patent: Sep. 3, 1991

[54] PACKAGING MACHINE

[75] Inventors: Fumiyuki Iwano, Tokushima; Kazuo Sasaki, Tokyo, both of Japan

[73] Assignees: Shikoku Kakoki Co., Ltd., Itano; Jujo Paper Co., Ltd., Tokyo, both of Japan

[21] Appl. No.: 506,041

[22] Filed: Apr. 9, 1990

[30] Foreign Application Priority Data

Apr. 10, 1989 [JP] · Japan ..... 1-91583

[51] Int. Cl.[5] ..... B65B 55/10

[52] U.S. Cl. ..... 53/167; 53/426; 53/551; 134/169 C; 134/170; 141/90; 141/91

[58] Field of Search ..... 53/167, 426, 550, 551; 134/54, 169 C, 170; 141/89, 90, 91; 422/302, 304

[56] References Cited

U.S. PATENT DOCUMENTS

| | | | |
|---|---|---|---|
| 3,269,079 | 8/1966 | Schmied | 53/426 |
| 3,854,874 | 12/1974 | Loliger et al. | 53/167 X |
| 3,911,642 | 10/1975 | Ernstsson et al. | 53/426 |
| 3,912,535 | 10/1975 | Rausér | 141/91 X |
| 4,055,035 | 10/1977 | Sjöstrand et al. | 53/167 |
| 4,213,795 | 7/1980 | Ernstsson et al. | 141/91 X |
| 4,218,265 | 8/1980 | Fuchs et al. | 141/90 X |
| 4,534,494 | 8/1985 | Hautemont | 141/91 X |
| 4,623,516 | 11/1986 | Weiler et al. | 141/91 X |
| 4,784,697 | 11/1988 | Bordini | 53/426 X |

FOREIGN PATENT DOCUMENTS 53-16755 6/1978 Japan .

*Primary Examiner*—Robert L. Spruill
*Assistant Examiner*—Daniel B. Moon
*Attorney, Agent, or Firm*—Armstrong, Nikaido, Marmelstein, Kubovcik & Murray

[57] ABSTRACT

A packaging machine for forming a web of packaging material into a vertical tube, filling contents into the tube, dividing the tube into lengths each corresponding to one container and forming each length into a baglike container. The machine comprises a filling device for filling a liquid into the tube to a specified level with the lower end of the tube closed, and a cleaning device for cleaning a required portion of the filling device. The filling device has a vertical filling pipe to be covered with the tube. The cleaning device has a vertical tubular jacket having a top wall and covering the upper portion of the filling pipe, a bottomed tubular cleaner removably connectable to the jacket for covering the lower portion of the filling pipe, and a cleaning liquid collecting duct removably connectable to the jacket. A cleaning liquid is supplied to the filling pipe with the duct connected to the jacket to clean the pipe and is thereafter collected through the duct.

3 Claims, 4 Drawing Sheets

PACKAGING MACHINE

BACKGROUND OF THE INVENTION

The present invention relates to a packaging machine for forming a web of packaging material into a vertical tube, filling contents into the tube, dividing the tube into lengths each corresponding to one container to form baglike containers and finally preparing rectangular parallelepipedal containers, and more particularly to a filling device and a cleaning device for use in such a packaging machine.

As disclosed, for example, in Examined Japanese Patent Publication No. 53-16755, such a packaging machine is known wherein a liquid filling pipe has a liquid contact lower portion separable from its upper portion and which is provided with a cleaning liquid collecting duct removably connectable to the upper portion of the filling pipe with the lower portion removed therefrom. To clean the filling pipe, the lower portion is removed from the upper portion and is cleaned separately from the upper portion, and a cleaning liquid is supplied to the upper portion with the collecting duct connected thereto for cleaning the upper portion of the filling pipe.

With the conventional machine, the lower portion of the filling pipe needs to be separated from its upper portion when the filling pipe is to be cleaned, and the separated lower portion must be connected to the upper portion after cleaning. Thus, the cleaning work requires a cumbersome procedure for the separation and connection.

SUMMARY OF THE INVENTION

The main object of the present invention is to provide a packaging machine free of the above problem.

The packaging machine of the present invention comprises a filling device for filling a liquid into a tube to a specified level with the lower end of the tube closed, and a cleaning device for cleaning a required portion of the filling device. The filling device comprises a filling pipe including a vertical portion with an open lower end for the tube to be placed therearound, the vertical portion having a liquid contact portion at its lower end, a control member removably attached to the liquid contact portion for controlling the level of the liquid to be filled into the tube by regulating the amount of liquid to be discharged from the open lower end of the liquid contact portion, and means for supplying the liquid into the filling pipe. The cleaning device comprises a vertical tubular jacket provided around the vertical portion above the liquid contact portion inside the tube and having a top wall and a duct joint opening, a bottomed tubular cleaner to be provided around the liquid contact portion and removably connected at its upper end to the lower end of the jacket with the control member removed from the liquid contact portion, and a cleaning liquid collecting duct removably attachable to the duct joint opening. The supplying means is adapted to supply to the filling pipe a cleaning liquid in place of the liquid to be filled.

Thus, the packaging machine of the present invention has the bottomed tubular cleaner which is removably connectable at its upper end to the lower end of the jacket to cover the liquid contact portion of the filling pipe. Accordingly, the cleaner is fitted over the liquid contact portion by lifting the cleaner from below the liquid contact portion and connecting the upper end of the cleaner to the lower end of the jacket.

The cleaning device includes the cleaning liquid collecting duct which is removably connectable to the duct joint opening portion of the jacket, and a cleaning liquid can be supplied to the filling pipe. Accordingly, when the cleaning liquid is supplied to the filling pipe with the collecting duct attached to the joint opening, the cleaning liquid flows through the filling pipe and is discharged from the open lower end thereof while cleaning the interior of the pipe. The discharged cleaning liquid is reversed inside the cleaner, flows upward through the space between the jacket and the filling pipe, is discharged from the duct joint opening and is collected into the collecting duct. In the meantime, the filling pipe is externally cleaned.

The cleaner and the collecting duct are removed after the completion of the cleaning work.

In this way, the filling pipe can be cleaned with the cleaning liquid by connecting the upper end of the cleaner to the lower end of the jacket, connecting the cleaning liquid collecting duct to the jacket and supplying the cleaning liquid to the filling pipe without separating the pipe off.

BRIEF DESCRIPTION OF THE DRAWINGS

The drawings show an embodiment of the present invention.

DESCRIPTION OF THE PREFERRED EMBODIMENT

An embodiment of the invention will be described below with reference to the drawings.

Figure 3:
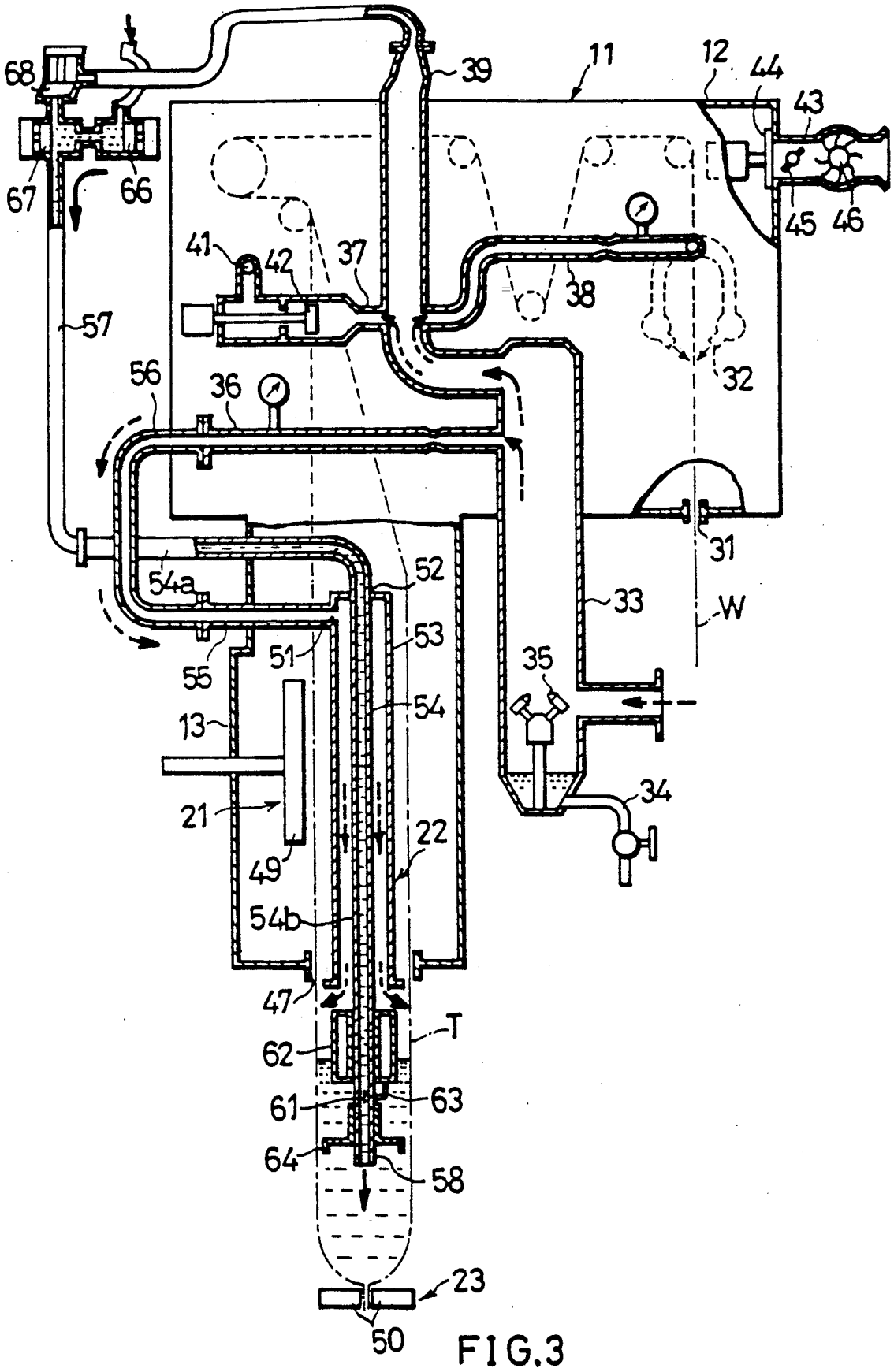
FIG. 3 is a diagram showing the machine in filling operation.

Referring to FIG. 3, the illustrated packaging machine will be described first generally in its entirety.

The packaging machine has a closed aseptic chamber 11 for separating a required packaging operation space from outside air. The aseptic chamber 11 comprises an upper chamber 12 having a rectangular vertical section which is elongated laterally, and a lower chamber 13 having a rectangular vertical section elongated vertically and in communication with the left portion of the upper chamber 12 through the bottom wall thereof.

In the upper chamber 12 through the lower chamber 13, a tube forming device 21 is disposed for forming a web W of packaging material into a vertical tube T. Disposed in the lower chamber 13 and therebelow is a filling device 22 for filling contents into the tube T. Provided below the filling device 22 is a container forming device 23 for forming baglike containers by sealing and dividing the tube T, filled with the contents, at an interval corresponding to the length of each container while intermittently feeding the tube T downward by that length at a time. An unillustrated web sterilizing device is disposed below the right portion of the upper chamber 12. The web sterilizing device is provided with a tank containing an aqueous solution of hydrogen peroxide for passing the web W therethrough.

A web inlet 31 is formed in the right portion of the bottom wall of the upper chamber 12. Nozzles 32 for forcing the hydrogen peroxide solution off the web W are disposed immediately above the web inlet 31 inside the upper chamber 12, whereby the solution adhering to the web W during sterilization is removed. A plurality of guide rollers are arranged along a direction from above the nozzles 32 to above the lower chamber 13. The web W led into the upper chamber 12 is passed over these rollers one after another and guided to the tube forming device 21.

The upper chamber 12 has a hot air supply main duct 33 disposed upstream from the lower chamber 13 with respect to the direction of transport of the web. A hydrogen peroxide aqueous solution supply pipe 34 is connected to the lower end of the main duct 33. The hot air supply main duct 33 is adapted to hold in its lower end portion an aqueous solution of hydrogen peroxide to a given level, and is provided with spray nozzles 35 for aspirating the solution held in the end portion. The main duct 33 extends into first to fourth hot air supply branch ducts 36 to 39. The first branch duct 36 extends leftward from the main duct 33. The second branch duct 37 communicates with an air outlet 41 provided in the upper chamber 12 and has a shutoff valve 42. The third branch duct 38 is connected to the hydrogen peroxide solution removal nozzles 32. The fourth branch duct 39 extends upward beyond the upper chamber top wall. The upper camber 12 has connected to its right side wall a hot air discharge duct 43 which is provided with a shutoff valve 44, damper 45 and blower 46 which are arranged in a direction away from the chamber 12 in this order. A tube outlet 47 is formed in the bottom wall of the lower chamber 13.

Figure 1:
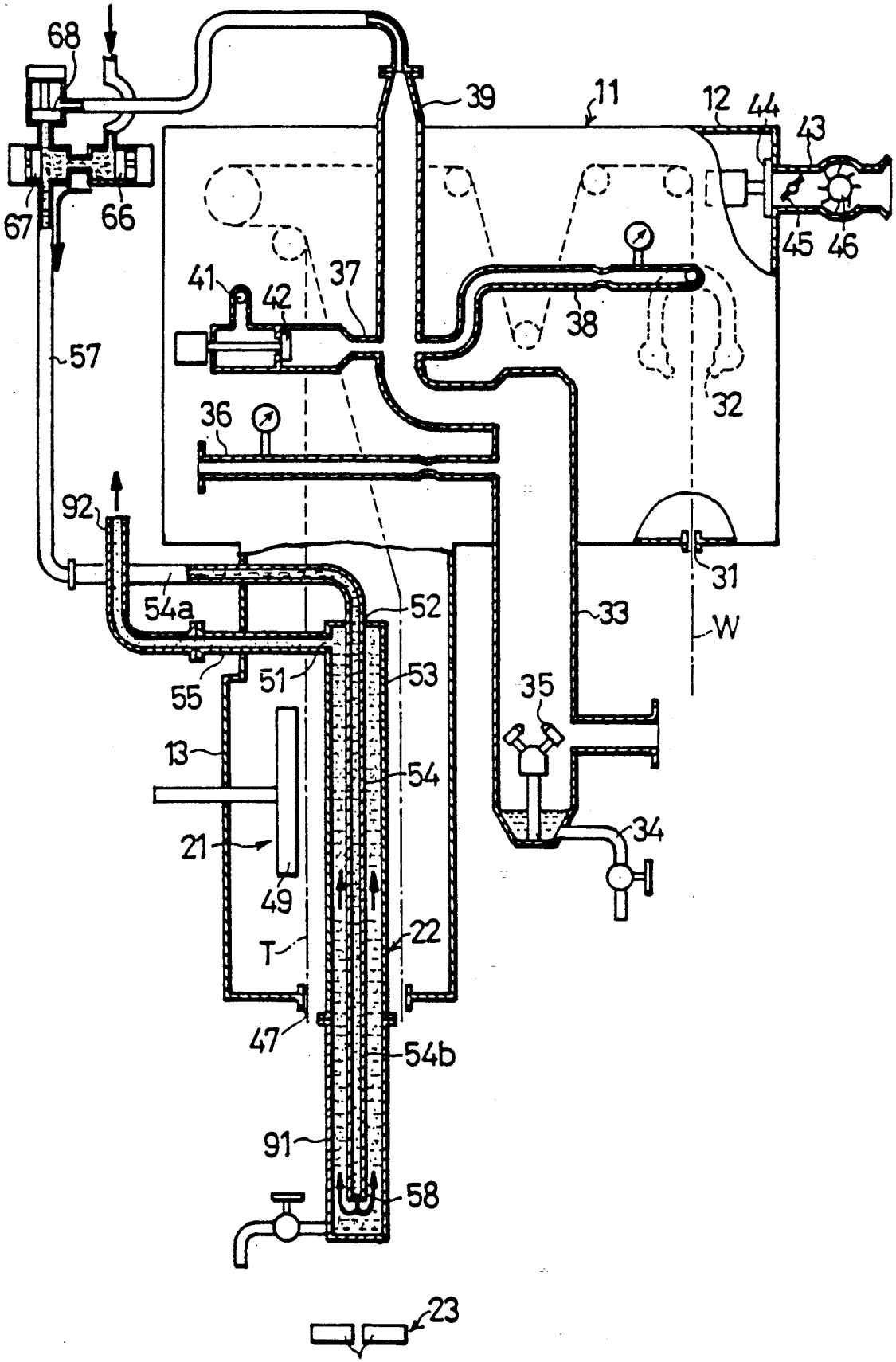
FIG. 1 is a diagram showing a packaging machine during cleaning.
Figure 2:
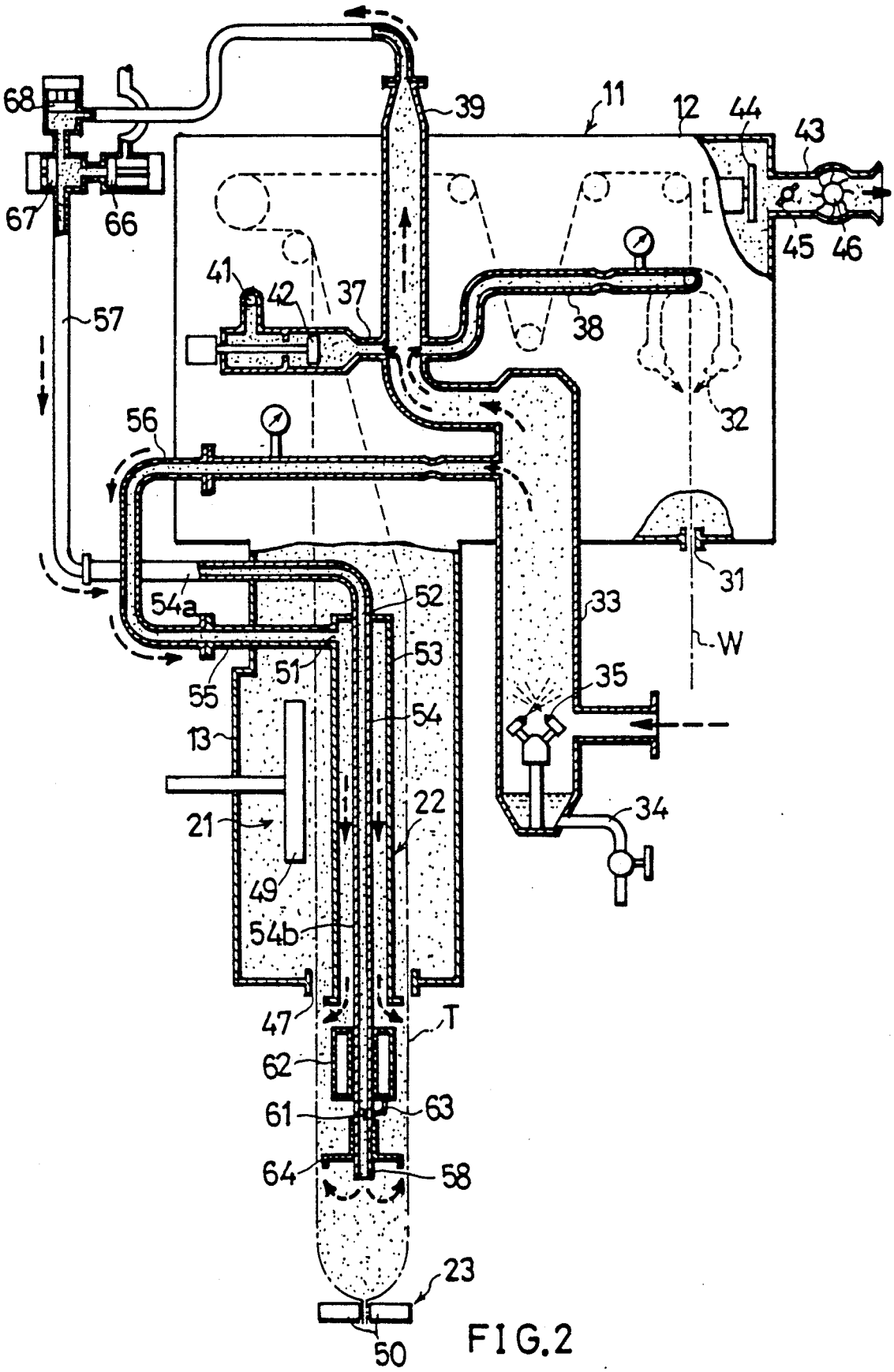
FIG. 2 is a diagram showing the machine during sterilization.

The tube forming device 21 and the container forming device 23 are already known and therefore will not be described in detail. FIGS. 1 to 3 show a heater 49 of the tube forming device 21 and jaws 50 of the container forming device 23. The heater 49 is provided for heating the edges of the web W. The jaws 50 clamp the tube T transversely thereof for sealing and cut the widthwise midportion of the seal while being reciprocatingly moved longitudinally of the tube T over a stroke length corresponding to one container.

The filling device 22 is mainly positioned inside the lower chamber 13 although the lower end of the device extends downward below the lower chamber through the tube outlet 47. The filling device 22 has a vertical tubular jacket 53 formed with a duct joint opening 51 at the upper end of its peripheral wall and a pipe inserting opening 52 in its top wall, and a filling pipe 54 extending through the inserting opening 52. A horizontal connecting tube 55 is attached to the jacket peripheral wall around the duct joint opening 51. A U-shaped connecting duct 56 is removably connected to the projecting end of the tube 55 and the forward end of the first branch duct 36. The filling pipe 54 comprises an upper horizontal portion 54*a* and a lower vertical portion 54*b*. The upper horizontal portion 54*a* extends outward from the lower chamber 13 through the upper end of the left side wall of the chamber and has connected to its outer end a supply pipe 57 extending from an unillustrated tank containing the liquid to be filled. The liquid to be filled or a cleaning liquid is supplied to the pipe 57 separately. The vertical portion 54*b* is disposed concentrically with the jacket 53 and has a liquid contact portion 58 at its lower part projecting downward below the jacket 53. The liquid contact portion 58 has a damper 61 attached thereto pivotally movably upward and downward. At a higher level than the damper 61, an annular float 62 is fitted around the liquid contact portion 58 vertically movably. The movable end of the damper 61 is connected to the float 62 by a connecting member 63. An annular pressure plate 64 is attached to the liquid contact portion 58 near the lower end thereof.

The supply pipe 57 has first and second shuftoff valves 66 and 67 arranged in series. The second shutoff valve 67 has connected thereto the fourth branch duct 39, which is provided with a third shutoff valve 68.

Figure 4:
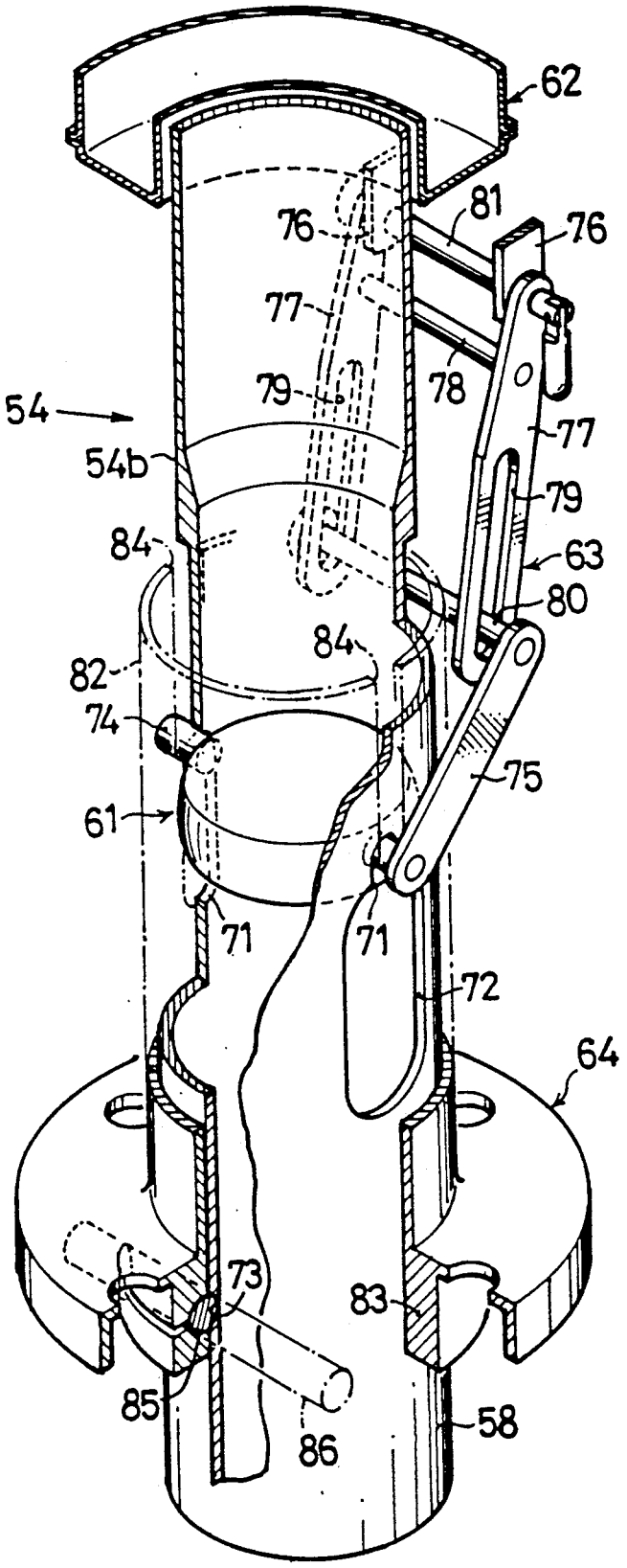
FIG. 4 is a perspective view showing the lower end portion of a filling pipe and the neighborhood thereof.

The damper 61, float 62, connecting member 63 and pressure plate 64 are removable from the liquid contact portion 58 of the filling pipe 54 as will be described in detail with reference to FIG. 4.

The liquid contact portion 58 of the filling pipe 54 is formed approximately at the midportion of its height with two vertically elongated slits 71 which are opposed to each other. The lower end of one of the slits 71 extends into a vertically elongated aperture 72 for passing the damper therethrough. A horizontal cutout 73 is formed in the liquid contact portion 58 near the lower end thereof. A horizontal pivot 74 secured to the damper 61 is inserted at its opposite ends through the respective slits 71. An arm 75 is secured to one of the projecting ends of the pivot 74. Two lugs 76 are provided on the bottom side of the float 62. The connecting member 63 comprises parallel bars 77, and a connecting rod 78 provided between the bars. The parallel bars 77 are each formed with a longitudinal slit 79, and these slits 79 are opposed to each other. A horizontal pin 80 inserted through the slits 79 has one end connected to the forward end of the arm 75. One end of each parallel bar 77 is fitted over the lug 76 on the float 62 from outside, with a connecting pin 81 removably extending through the fitted end and the lug. The pressure plate 64 has an upwardly projecting tubular portion 82 and a downwardly projecting tubular portion 83 which are slidably fitted around the liquid contact portion 58 of the filling pipe 54. Two slits 84 each having an open upper end are formed in the upward tubular portion 82 and opposed to each other, and have the respective ends of the pivot 74 fitted therein. The downward tubular portion 83 has a horizontal through bore 85 coinciding with the cutout 73 in the liquid contact portion 58. A fixing pin 86 partly fitted in the cutout 73 is inserted through the bore 85, whereby the pressure plate 64 is attached to the liquid contact portion 58. In this state, the opposite ends of the pivot 74 are held by the upper ends of the slitted portions 71 of the liquid contact portion 58 from above and by the lower ends of the slitted portions 84 of the pressure plate 64 from below, whereby the pivot 74 is positioned in place with respect to the direction of height.

The pressure plate 64 is downwardly removable from the filling pipe 54 after removing the fixing pin 86. Next, the connecting pin 81 is removed from the connections between the float 62 and the connecting member 63. The damper 61 is then withdrawn from the filling pipe 54 through the damper passing aperture 72, whereby the damper 61 is removed from the filling pipe 54 along with the connecting member 63. Finally, the float 62 is downwardly removed from the filling pipe 54.

With reference to FIG. 3, hot air is sent into the jacket 53 through the supply main duct 33 and the first branch duct 36 during steady-state filling operation. This prevents deposition of condensed water vapor on the filling pipe 54 and, at the same time, evaporates off the hydrogen peroxide solution remaining on the web W. The first and second shutoff valves 66, 67 are both open, with the third shutoff valve 68 held closed to supply the liquid to be filled to the supply pipe 57. The liquid sent through the supply pipe 57 is filled by the filling pipe 54 into the tube T to a specified level which tube T is fitted around the jacket 53, etc. The filled tube T has been guided to a position below the lower chamber 13 where it has been sealed transversely thereof. The hot air sent into the jacket 53 fills the aseptic chamber 11 through the tube T. Hot air also fills the chamber 11 through the second branch duct 37.

With reference to FIG. 1, the filling pipe 54 is cleaned in the following manner after the completion of the filling operation. The supply of hot air is discontinued. First, the tube T is cut at a level slightly higher than the lower end of the jacket 53. Next, the damper 61, float 62, connecting member 63 and pressure plate 64 are removed from the filling pipe 54 in the manner already stated above. A bottomed tubular cleaner 91 separatedly prepared is then fitted around the liquid contact portion 58 of the filling pipe 54. The upper end of the cleaner 91 is removably connectable to the lower end of the jacket 53 by a suitable attaching means 91*a*. Subsequently, the connecting duct 56 is removed from the first branch duct 36 and from the connecting tube 55 of the jacket 53, and a cleaning liquid collecting duct 92 is attached to the connecting duct 55 in place of the duct 56. Instead of the liquid to be filled, a cleaning liquid is supplied to the supply pipe 57, whereupon the cleaning liquid flows through the filling pipe 54 and is discharged from the lower end thereof. The discharged liquid is reversed inside the cleaner 91, flows upward through the space between the jacket 53 and the filling pipe 54 and is collected into the collecting duct 92.

With reference to FIG. 2, the interior of the aseptic chamber 11 and various portions of the machine are sterilized in the following manner after the completion of the cleaning operation. First, the cleaner 91 is removed from the jacket 53, and the damper 61, float 62, connecting member 63 and pressure plate 64 which have been cleaned separately are attached to the filling pipe 54. The tube T is then pulled down to the position of the container forming device 23, and the lower end of the tube is sealed off. Next, the cleaning liquid collecting duct 92 is removed from the connecting tube 55 of the jacket 53, and the connecting duct 56 is installed in the original position. The first shutoff valve 66 is closed, and the second and third shutoff valves 67, 68 are opened. An aqueous solution of hydrogen peroxide is then released from the nozzle 35 along with supply of hot air, whereby the hot air containing the solution is supplied to the jacket via the first branch duct 36 and to the filling pipe 54 via the fourth branch duct 39 and the supply pipe 57. The hot air thus sent into the jacket 53 and the filling pipe 54 fills the aseptic chamber 11 through the tube T and is then discharged from the chamber 11 by the operation of the blower 46.

On completion of the sterilizing operation, the first and second shutoff valves 66, 67 are both opened, the third shutoff valve 68 is closed, and the liquid to be filled is supplied to the filling pipe 54 through the supply pipe 57, whereby the machine is brought into a filling operation without allowing the sterilized portions to be exposed to the outside air.

While the invention has been particularly shown and described in reference to preferred embodiments thereof, it will be understood by those skilled in the art that changes in form and details may be made therein without departing from the spirit and scope of the invention.

What is claimed is:

1. A packaging machine for forming a web of packaging material into a vertical tube, filling contents into the tube, dividing the tube into lengths each corresponding to one container and forming each length into a bag-like container, the packaging machine comprising:

a filling means for filling a liquid into the tube to a specified level with the lower end of the tube closed; and a cleaning means for cleaning a required portion of the filling means, the filling means including:

a filling pipe having a vertical portion with an open lower end for the tube to be placed therearound, the vertical portion having a liquid contact portion at its lower part, a first attaching means for removably attaching a control member to the liquid contact portion for controlling the level of the liquid to be filled into the tube by regulating the amount of liquid to be discharged from the open lower end of the liquid contact portion, means for supplying the liquid into the filling pipe, and a vertical tubular jacket provided around the vertical portion above the liquid contact portion inside the tube and having a top wall and a duct joint opening, the cleaning means including:

a second attaching means for removably attaching a bottomed tubular cleaner provided around the liquid contact portion, the second attaching means removably connects an upper end of the bottomed tubular cleaner to the lower end of the jacket with the control member removed from the liquid contact portion, and a cleaning liquid collecting duct removably attachable to the duct joint opening, the supplying means supplies to the filling pipe a cleaning liquid in place of the liquid.

2. A packaging machine as defined in claim 1, wherein the upper end of the bottomed tubular cleaner is removably attached to the lower end of the jacket, and wherein the supplying means has a supply pipe through which the liquid to be filled passes through to the filling pipe, and a first shutoff valve mounted on the supply pipe, a first hot air supply duct being connected via a second shutoff valve to the supply pipe downstream from the first shutoff valve, a second hot air supply duct being removably attachable to the duct joint opening, the first and second hot air supply ducts being internally provided with means for spraying a mist of hydrogen peroxide aqueous solution.

3. A packaging machine as defined in claim 1, further comprising an aseptic chamber for substantially enclosing an upper portion of the jacket and having an air discharge duct connected thereto, the air discharge duct including a blower, and hot air containing the mist of hydrogen peroxide aqueous solution, wherein the control member is removably attached to the liquid contact portion, the hot air with the aqueous solution being discharged from the jacket and the open lower end of the filling pipe and introduced into the aseptic chamber through the tube, the jacket and the liquid contact portion of the filling pipe with the lower end of the tube closed.

* * * * *